US007382284B1

(12) United States Patent
Armstrong et al.

(10) Patent No.: US 7,382,284 B1
(45) Date of Patent: Jun. 3, 2008

(54) AIRCRAFT SURFACE OPERATIONS GUIDANCE ON HEAD UP DISPLAY

(75) Inventors: Robert A. Armstrong, Camby, OR (US); John G. Wilson, West Linn, OR (US); Kenneth A. Zimmerman, Portland, OR (US); Gary C. Bailey, Beaverton, OR (US); Louis J. Bailey, Sherwood, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 651 days.

(21) Appl. No.: 10/953,227

(22) Filed: Sep. 29, 2004

(51) Int. Cl.
*G08B 21/00* (2006.01)

(52) U.S. Cl. ..... 340/958; 340/980; 340/971; 340/972; 340/979

(58) Field of Classification Search ..... 340/958, 340/945, 971, 972, 979, 980, 995.17
See application file for complete search history.

(56) References Cited

U.S. PATENT DOCUMENTS 5,689,273 A * 11/1997 Bailey et al. ..... 342/407
6,246,342 B1 * 6/2001 Vandevoorde et al. ..... 340/961
6,411,890 B1 * 6/2002 Zimmerman ..... 701/120
6,571,166 B1 * 5/2003 Johnson et al. ..... 701/120
6,731,226 B2 * 5/2004 Walter ..... 340/972
6,862,519 B2 * 3/2005 Walter ..... 701/120

* cited by examiner

*Primary Examiner*—Toan N. Pham
(74) *Attorney, Agent, or Firm*—Nathan O. Jensen; Kyle Eppele

(57) ABSTRACT

The present invention is a method and system of aircraft surface operations guidance on a head up display. An aircraft surface operations guidance method includes the following steps. At time $t_1$, a taxi guidance cue and a trend vector are displayed on a head up display of an aircraft. The taxi guidance cue represents a desired position of an aircraft control point of the aircraft at time $t_2$. The trend vector represents a predicted path of the aircraft control point from time $t_1$ to time $t_2$ based on a state of the aircraft at time $t_1$. The trend vector includes a tip representing a predicted position of the aircraft control point at time $t_2$. The tip is maintained within the taxi guidance cue so that the aircraft control point may reach the desired position at time $t_2$.

20 Claims, 4 Drawing Sheets

AIRCRAFT SURFACE OPERATIONS GUIDANCE ON HEAD UP DISPLAY

FIELD OF THE INVENTION

This invention relates generally to aircraft surface operations, and particularly to a method and system of aircraft surface operations guidance on a head up display.

BACKGROUND OF THE INVENTION

There is considerable interest in enhancing surface guidance for aircraft. For example, after an aircraft lands on a runway at an airport, the next step is to taxi the aircraft to a desired destination such as a passenger-loading/unloading gate. A pilot can easily become confused or lost amid a number of runways, taxiways, ramps, and buildings that make up an airport. With airports becoming more crowded, aircraft often spend considerable time taxiing between runways and gates. Taxi time is even longer if the pilot makes a wrong turn, becomes lost, or blunders onto the wrong runway or taxiway. In addition, a wrong turn or navigation blunder may cause delays for other aircraft at the airport. The problem is more significant at large airports and is particularly significant at night when the multitude of lights can make it more difficult to taxi the aircraft to the desired destination.

Efficient taxi operations save time and money. One feature of an airport surface guidance capability is the presentation of airport features such as runways and taxiways that are readily made available to the pilot. One approach to present such feature information is on a head-up display (HUD) that is displayed in the forward line of sight of the pilot looking out the front windshield of the aircraft. The pilot typically enters or selects a taxi path that has been approved by ground controllers. The taxi path or route is then displayed on the HUD. The pilot can view the features displayed on the HUD as being overlaid on the surface features the pilot can normally see through the windshield. The airport features may give a pilot situational awareness of where the aircraft is relative to the selected taxi path. However, the use of conformal depictive symbology alone on a HUD for aircraft surface operations in reduced visibility and/or low ambient light situations does not provide sufficient cueing for precise expeditious movement of the aircraft to and from the active runway along a clearance issued taxi path.

Thus, it would be desirable to provide an improved method and system of aircraft surface operations guidance on a head up display.

SUMMARY OF THE INVENTION

In an exemplary aspect of the present invention, an aircraft surface operations guidance method includes the following steps. At time $t_1$, a taxi guidance cue and a trend vector are displayed on a head up display of an aircraft. The taxi guidance cue represents a desired position of an aircraft control point of the aircraft at time $t_2$. The trend vector represents a predicted path of the aircraft control point from time $t_1$ to time $t_2$ based on a state of the aircraft at time $t_1$. The trend vector includes a tip representing a predicted position of the aircraft control point at time $t_2$. The tip is maintained within the taxi guidance cue so that the aircraft control point may reach the desired position at time $t_2$.

In an additional exemplary aspect of the present invention, an aircraft surface operations guidance system includes means for displaying, at time $t_1$, a taxi guidance cue and a trend vector on a head up display of an aircraft. The taxi guidance cue represents a desired position of an aircraft control point of the aircraft at time $t_2$. The trend vector represents a predicted path of the aircraft control point from time $t_1$ to time $t_2$ based on a state of the aircraft at time $t_1$. The trend vector includes a tip representing a predicted position of the aircraft control point at time $t_2$. The tip is maintained within the taxi guidance cue so that the aircraft control point may reach the desired position at time $t_2$.

In another exemplary aspect of the present invention, an aircraft surface operations guidance system includes a head up display in an aircraft. The head up display is suitable for showing, at time $t_1$, a taxi guidance cue and a trend vector. The taxi guidance cue represents a desired position of an aircraft control point of the aircraft at time $t_2$. The trend vector represents a predicted path of the aircraft control point from time $t_1$ to time $t_2$ based on a state of the aircraft at time $t_1$. The trend vector includes a tip representing a predicted position of the aircraft control point at time $t_2$.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
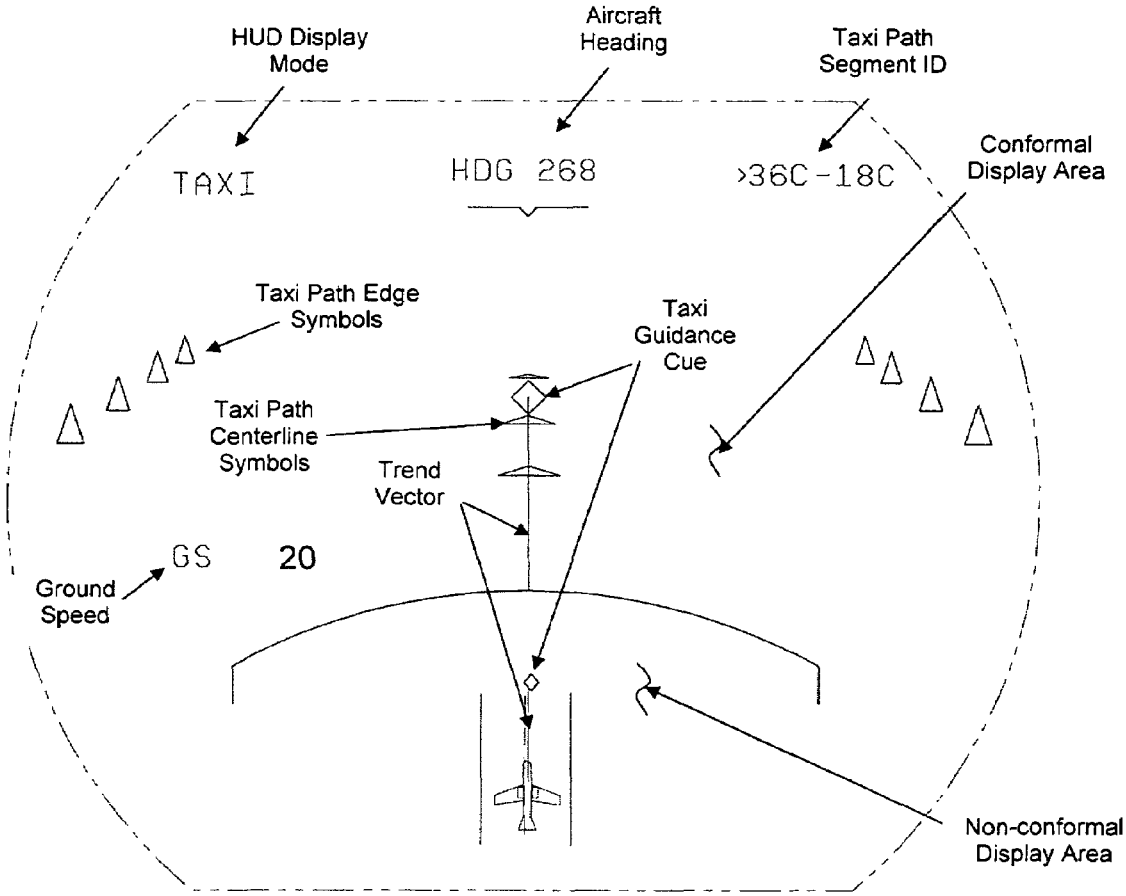
FIG. 1 is a schematic diagram illustrating a head up display showing a taxi guidance cue and a trend vector in accordance with an exemplary embodiment of the present invention, where the trend vector is a straight line.
Figure 2:
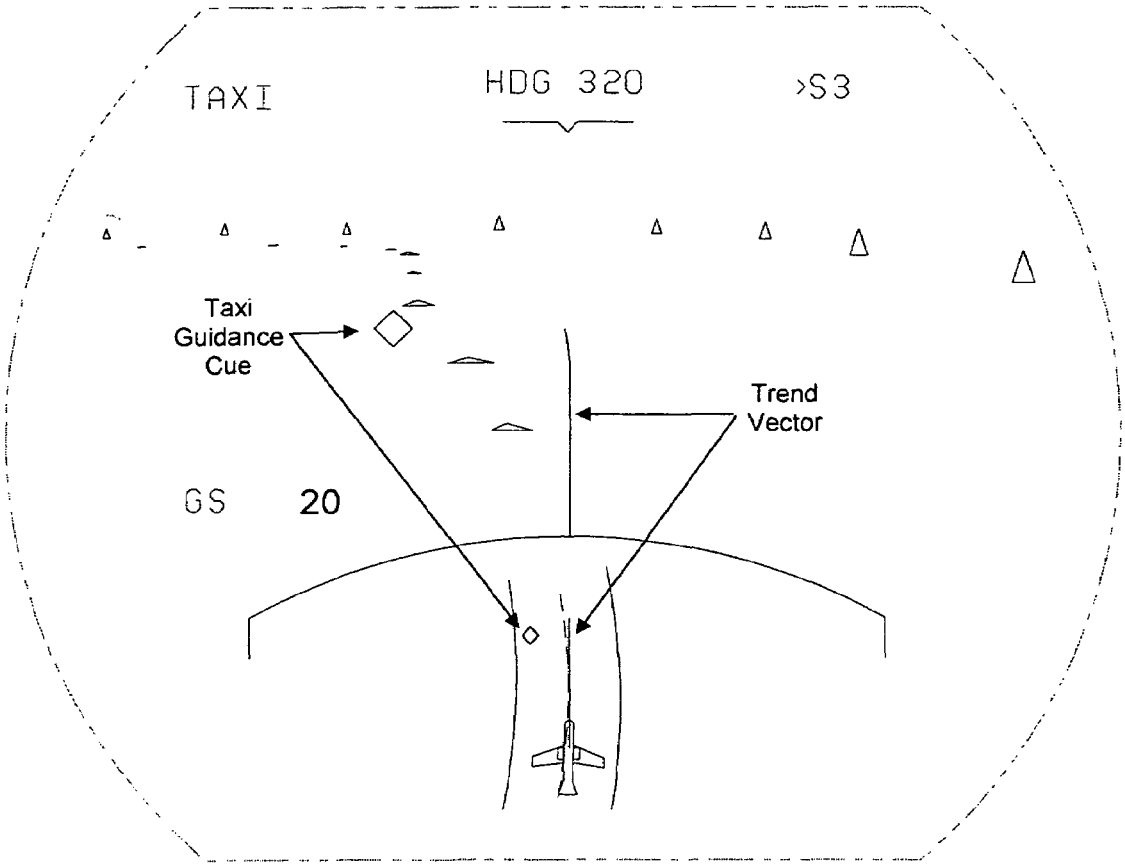
FIG. 2 is a schematic diagram illustrating a head up display showing a taxi guidance cue and a trend vector in accordance with an exemplary embodiment of the present invention, where the taxi guidance cue deviates from the trend vector.
Figure 3:
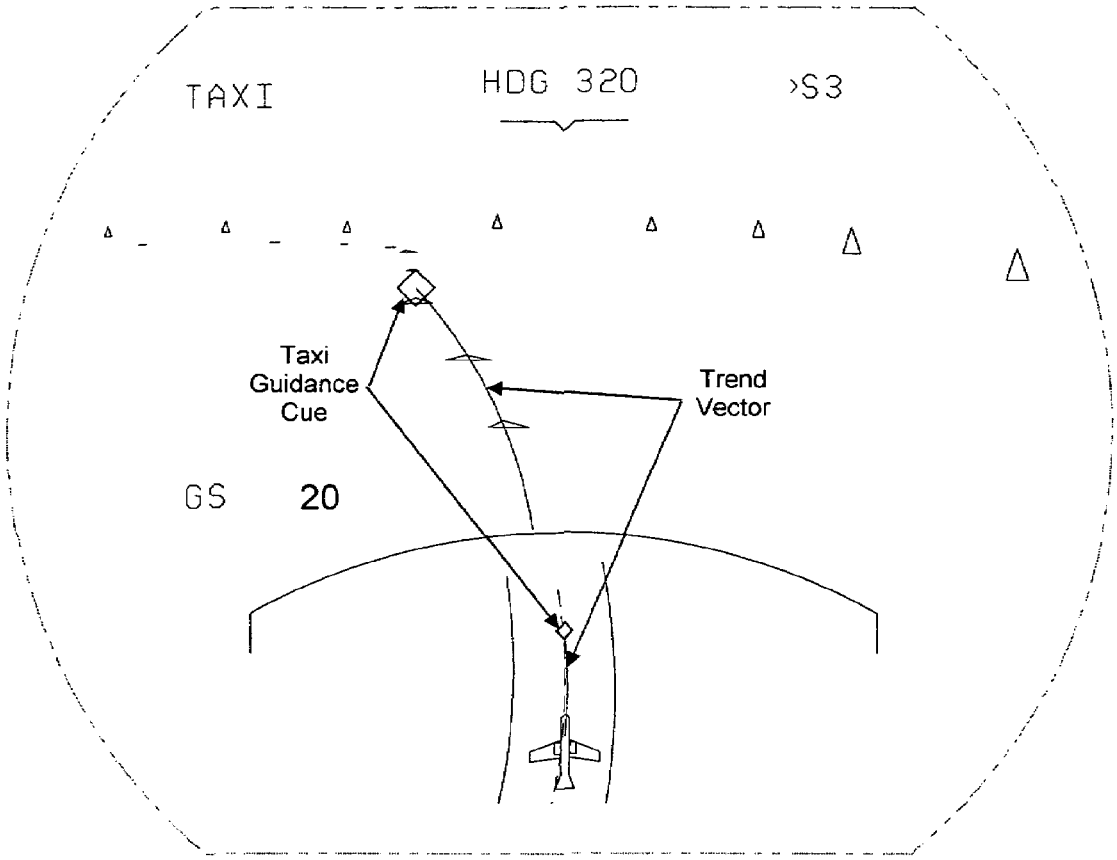
FIG. 3 is a schematic diagram illustrating a head up display showing a taxi guidance cue and a trend vector in accordance with an exemplary embodiment of the present invention, where the trend vector is a curved line.

FIGS. 1 through 3 illustrate a head up display of an aircraft showing a taxi guidance cue and a trend vector in accordance with an exemplary embodiment of the present invention. The present invention utilizes a taxi guidance cue in conjunction with a trend vector to allow the pilot to navigate accurately and expeditiously a cleared taxi path in reduced visibility ground conditions. As shown, the taxi guidance cue is a diamond shaped symbol. Alternatively, the taxi guidance cue may be a circle, a square, a rectangle, a triangle, or any shape as may be contemplated by a person of ordinary skill in the art. The trend vector may be a straight line (see, e.g., FIG. 1), a curved line (see, e.g., FIG. 3), or the like. As shown in FIGS. 1 through 3, the taxi guidance cue and the trend vector are displayed in a conformal manner (i.e., they have a true one-for-one relationship with the outside real world) in a conformal display area of the head up display and in a non-conformal manner (companion scaled) in a non-conformal display area of the head up display. Alternatively, the taxi guidance cue and the trend vector may be displayed in either a conformal display area or a non-conformal display area of the head up display.

The taxi guidance cue and the trend vector may be displayed on the head up display at time $t_1$ such as current time, or the like, as shown in FIGS. 1 through 3. The taxi guidance cue represents a desired position of an aircraft control point of the aircraft at time $t_2$ such as seconds later from the current time. The aircraft control point may be located midway between a left main landing gear and a right main landing gear of the aircraft. The desired position of the aircraft control point at time $t_2$ may be determined by a taxi guidance command received by the aircraft. The displayed taxi guidance command may be computed by taxi guidance algorithms executed in the HUD computer utilizing the current aircraft position, the current aircraft state (e.g., ground speed, heading, and turn rate, etc.), and a defined taxi path as input. The defined taxi path is a series of position points joined by line segments or curves that represent the taxi path at the airport facility. The taxi path may be stored in a memory or database of the HUD computer, may be received by the HUD computer from another onboard aircraft data storage system, or may be transmitted to the aircraft from a data system located on the airport facility. The trend vector represents a predicted path of the aircraft control point from time $t_1$ to time $t_2$ based on a state of the aircraft at time $t_1$. The state of the aircraft may include the ground speed, the heading, the turn rate, and the like of the aircraft. Those of ordinary skill in the art will understand how the state of the aircraft is determined. The trend vector may include a tip (i.e., endpoint) representing a predicted position of the aircraft control point at time $t_2$. When the taxi guidance cue and the trend vector are displayed in a conformal display area of the head up display, the predicted position represented by the tip is preferably 200 feet away from a position of the aircraft control point at time $t_1$. When the taxi guidance cue and the trend vector are displayed in a non-conformal display area of the head up display, the predicted position represented by the tip is preferably 120 feet away from a position of the aircraft control point at time $t_1$. Those of ordinary skill in the art will understand that a different distance between the predicted position represented by the tip of the trend vector and the position of the aircraft control point at time $t_1$ may be used without departing from the scope and spirit of the present invention. The guidance is satisfied by maintaining the tip of the trend vector within the taxi guidance cue. The guidance may be derived such that it may provide smooth and continuous cueing during the entire taxi path including straight and curved taxi segments as well as the transitions to and from the curved segments (turns).

As shown in FIG. 1, the aircraft is traveling at 20 knots straight forward along a straight taxi path segment, and the trend vector is a straight line. The trend vector normally overlays the taxiway centerline markings or the pilot's desired taxi path ahead. In the conformal display area, the tip of the trend vector is inside the taxi guidance cue. When a taxi guidance command requires steering to the left or right, the taxi guidance cue moves in the appropriate direction. For example, as shown in FIG. 2, the aircraft is traveling forward in a straight line at 20 knots. However, the taxi path ahead is curved to the left. Thus, the taxi guidance cue deviates from the trend vector and is positioned left of the trend vector, indicating to the pilot to steer left to maintain position in the center of the taxi path. If the pilot steers to the left, the trend vector may bend to the left, and vice-versa. In FIG. 3, in order to follow the taxi guidance command, the pilot has responded by steering left such that the tip of the trend vector is now within the taxi guidance cue. Note that the trend vector now overlays the displayed taxi path centerline.

Figure 4:
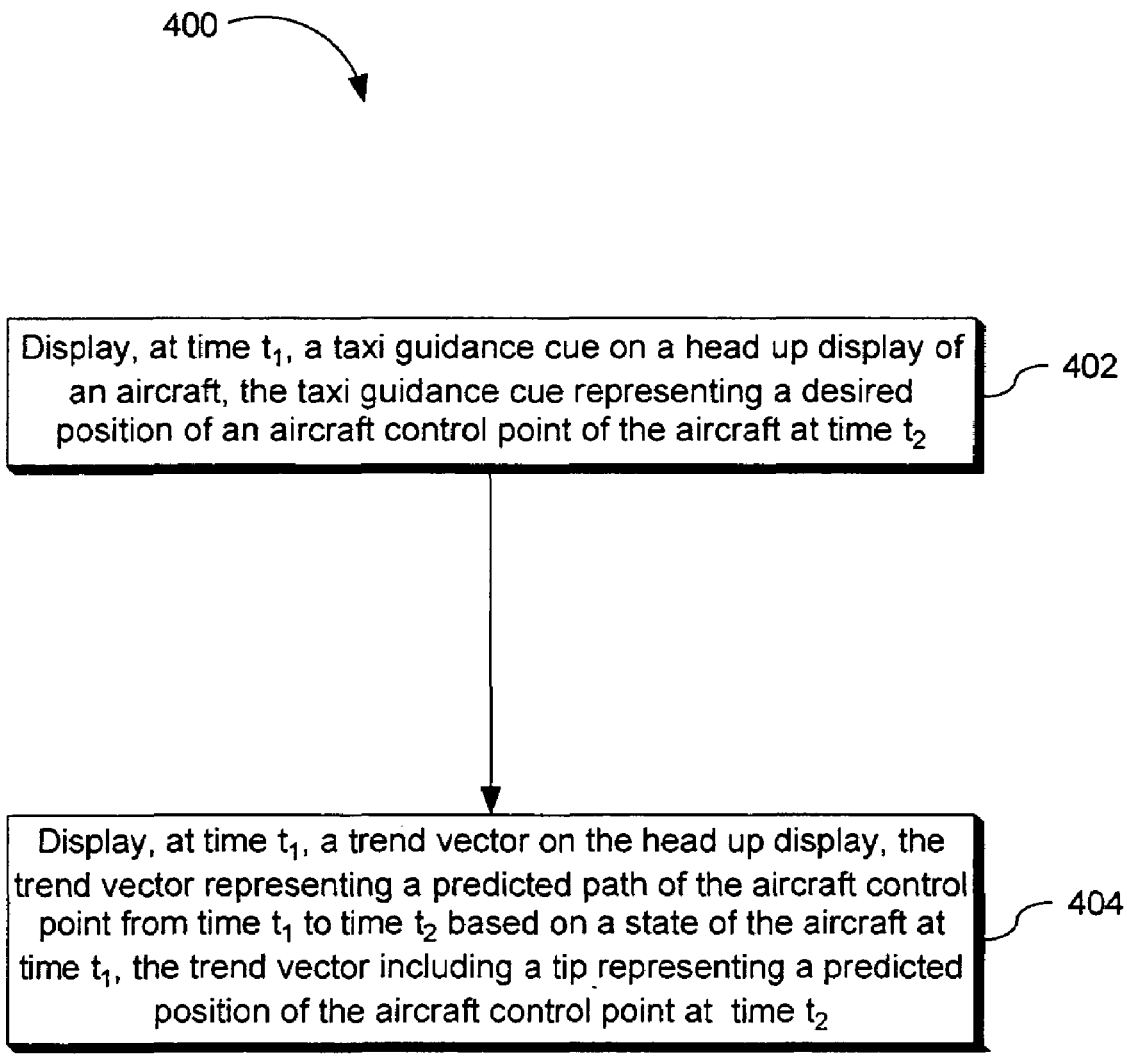
FIG. 4 is a flowchart of an aircraft surface operations guidance method in accordance with an exemplary embodiment of the present invention.

FIG. 4 is a flowchart of an aircraft surface operations guidance method 400 in accordance with an exemplary embodiment of the present invention. The method 400 may be implemented in the head up display shown in FIGS. 1 through 3. The method may start with step 402, in which a taxi guidance cue is displayed on a head up display of an aircraft at time $t_1$. The taxi guidance cue represents a desired position of an aircraft control point of the aircraft at time $t_2$. The aircraft control point may be located midway between a left main landing gear and a right main landing gear of the aircraft, or the like. The desired position of the aircraft control point at time $t_2$ may be determined by a taxi guidance command received by the aircraft. A trend vector is displayed on the head up display 404. The trend vector represents a predicted path of the aircraft control point from time $t_1$ to time $t_2$ based on a state of the aircraft at time $t_1$. The state of the aircraft may include the ground speed, the heading, the turn rate, and the like of the aircraft. The trend vector includes a tip representing a predicted position of the aircraft control point at time $t_2$. The tip is maintained within the taxi guidance cue so that the aircraft control point may reach the desired position at time $t_2$. When the taxi guidance cue deviates from the trend vector, the tip of the trend vector is maintained within the taxi guidance cue by steering the aircraft (e.g., by a pilot, by automation, or the like). The taxi guidance cue and the trend vector may be displayed in at least one of a conformal display area or a non-conformal display area of the head up display.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An aircraft surface operations guidance method, comprising steps of:

displaying, at time t1, a taxi guidance cue on a head up display of an aircraft, said taxi guidance cue representing a desired position of an aircraft control point of said aircraft at time t2; and displaying, at time t1, a trend vector on said head up display, said trend vector representing a predicted path of said aircraft control point from said time t1 to said time t2 based on a state of said aircraft at said time t1, said trend vector including a tip representing a predicted position of said aircraft control point at said time t2, wherein said tip is maintained within said taxi guidance cue so that said aircraft control point may reach said desired position at said time t2.

2. The aircraft surface operations guidance method of claim 1, further comprises:

when said taxi guidance cue deviates from said trend vector, maintaining said tip within said taxi guidance cue by steering said aircraft.

3. The aircraft surface operations guidance method of claim 1, wherein said taxi guidance cue and said trend vector are displayed in at least one of a conformal display area or a non-conformal display area of said head up display.

4. The aircraft surface operations guidance method of claim 1, wherein when said taxi guidance cue and said trend vector are displayed in a conformal display area of said head up display, said predicted position represented by said tip is 200 feet away from a position of said aircraft control point at said time t1.

5. The aircraft surface operations guidance method of claim 1, wherein when said taxi guidance cue and said trend vector are displayed in a non-conformal display area of said head up display, said predicted position represented by said tip is 120 feet away from a position of said aircraft control point at said time t1.

6. The aircraft surface operations guidance method of claim 1, wherein said taxi guidance cue is a diamond shaped symbol.

7. The aircraft surface operations guidance method of claim 1, wherein said trend vector is a straight line or a curved line.

8. The aircraft surface operations guidance method of claim 1, wherein said aircraft control point is located midway between a left main landing gear and a right main landing gear of said aircraft.

9. The aircraft surface operations guidance method of claim 1, wherein said desired position is determined by a taxi guidance command received by said aircraft.

10. The aircraft surface operations guidance method of claim 1, wherein said state of said aircraft at said time t1 includes at least one of ground speed, heading, or turn rate of said aircraft at said time t1.

11. An aircraft surface operations guidance system, composing:

means for displaying, at time t1, a taxi guidance cue on a head up display of an aircraft, said taxi guidance cue representing a desired position of an aircraft control point of said aircraft at time t2; and means for displaying, at time t1, a trend vector on said head up display, said trend vector representing a predicted path of said aircraft control point from said time t1 to said time t2 based on a state of said aircraft at said time t1, said trend vector including a tip representing a predicted position of said aircraft control point at said time t2, wherein said tip is maintained within said taxi guidance cue so that said aircraft control point may reach said desired position at said time t2.

12. The aircraft surface operations guidance system of claim 11, further comprises means for maintaining said tip within said taxi guidance cue by steering said aircraft when said taxi guidance cue deviates from said trend vector.

13. An aircraft surface operations guidance system, comprising:

a head up display in an aircraft, wherein said head up display is suitable for showing, at time t1, a taxi guidance cue and a trend vector, said taxi guidance cue representing a desired position of an aircraft control point of said aircraft at time t2, said trend vector representing a predicted path of said aircraft control point from said time t1 to said time t2 based on a state of said aircraft at said time t1, said trend vector including a tip representing a predicted position of said aircraft control point at said time t2.

14. The aircraft surface operations guidance system of claim 13, wherein said taxi guidance cue and said trend vector are shown in at least one of a conformal display area or a non-conformal display area of said head up display.

15. The aircraft surface operations guidance system of claim 13, wherein when said taxi guidance cue and said trend vector are shown in a conformal display area of said head up display, said predicted position represented by said tip is 200 feet away from a position of said aircraft control point at said time t1.

16. The aircraft surface operations guidance system of claim 13, wherein when said taxi guidance cue and said trend vector are shown in a non-conformal display area of said head up display, said predicted position represented by said tip is 120 feet away from a position of said aircraft control point at said time t1.

17. The aircraft surface operations guidance system of claim 13, wherein said taxi guidance cue is a diamond shaped symbol, and said trend vector is a straight line or a curved line.

18. The aircraft surface operations guidance system of claim 13, wherein said aircraft control point is located midway between a left main landing gear and a right main landing gear of said aircraft.

19. The aircraft surface operations guidance system of claim 13, wherein said desired position is determined by a taxi guidance command received by said aircraft.

20. The aircraft surface operations guidance system of claim 13, wherein said state of said aircraft at said time t1 includes at least one of ground speed, heading, or turn rate of said aircraft at said time t1.

* * * * *